United States Patent [19]

Schwartz et al.

[11] 3,982,881

[45] Sept. 28, 1976

[54] INVISIBLE FLARE BURNER

[75] Inventors: Robert E. Schwartz; Roger K. Noble, both of Tulsa, Okla.

[73] Assignee: John Zink Company, Tulsa, Okla.

[22] Filed: Feb. 3, 1975

[21] Appl. No.: 546,210

[52] U.S. Cl. ..... 431/202; 23/277 C

[51] Int. Cl.[2] ..... F23D 13/20

[58] Field of Search ..... 431/5, 202, 167; 23/277 C

[56] References Cited

UNITED STATES PATENTS

| | | | |
|---|---|---|---|
| 2,667,156 | 1/1954 | Brown et al. | 431/202 |
| 3,162,236 | 12/1964 | Williams | 431/202 |
| 3,219,418 | 11/1965 | Whitmire | 431/202 X |
| 3,244,220 | 4/1966 | Kloecker | 431/5 X |
| 3,779,689 | 12/1973 | Reed et al. | 431/5 X |

*Primary Examiner*—Edward G. Favors

*Attorney, Agent, or Firm*—Head, Johnson & Chafin

[57] ABSTRACT

An improved low pollution invisible flare burner comprises a tall stack lined with ceramic. The stack is supported above the ground level and has a wind screen surrounding the open portion below the stack floor. Primary air is introduced under pressure in a tube below and coaxial with the stack. The top of the tube contains a burner for the vented hydrocarbon gases. The top of the tube and the burner are at the level of the floor of the stack. Secondary air is introduced into the stack in the annular space between the primary air conduit and an opening in the floor of the stack. Turbulent mixing of the primary air and the vent gas, plus the availability of sufficient atmospheric air for complete combustion, plus the effect of heated ceramic in the vicinity of the flame, provide means for complete combustion of the vented gases with low emission of smoke and light.

8 Claims, 1 Drawing Figure

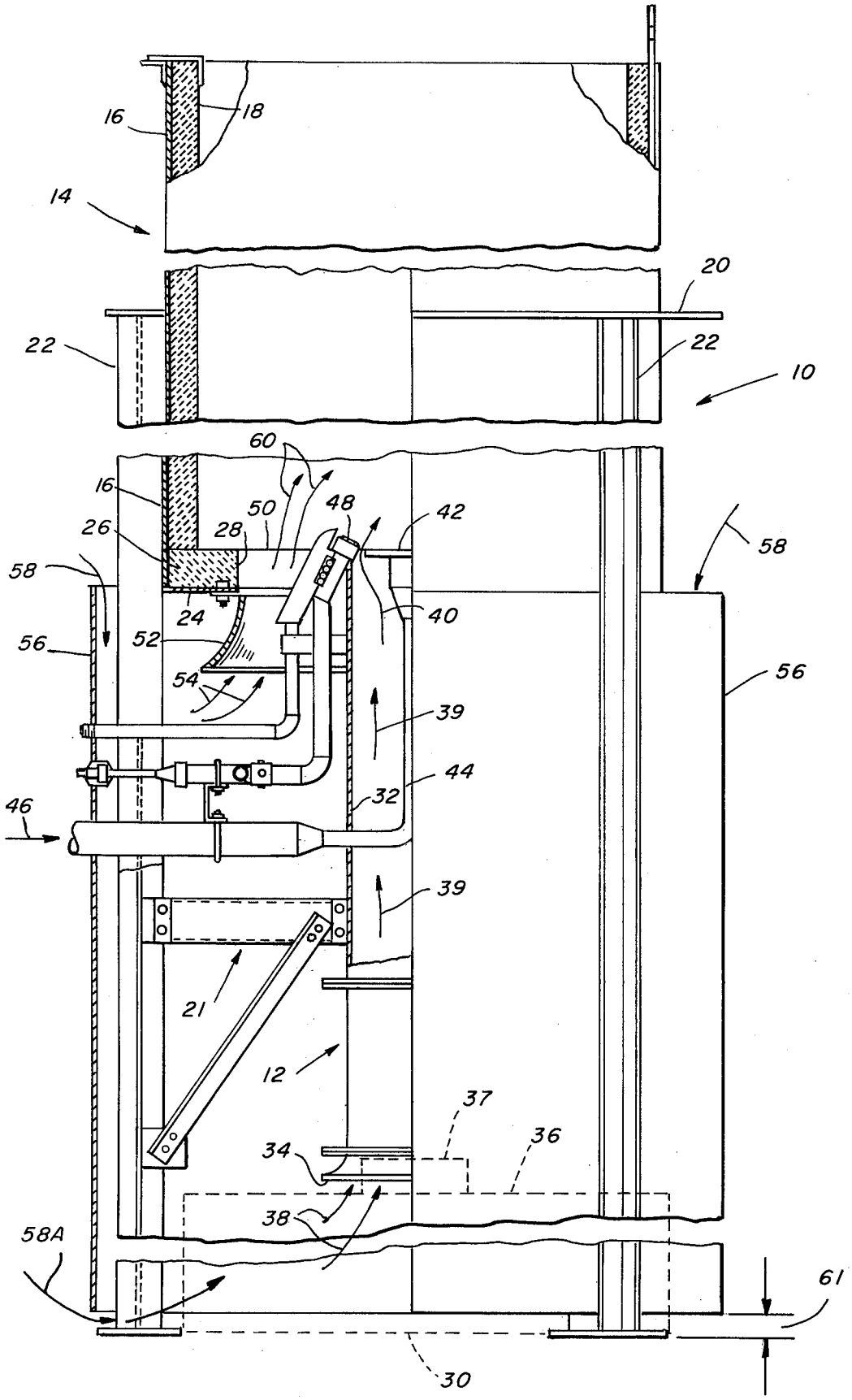
16
18
14
20
22
22
10
60
16
50
48
42
26
28
58
58
24
40
56
52
56
54
39
44
32
46
39
21
12
37
36
34
38
58A
61
30

INVISIBLE FLARE BURNER

BACKGROUND OF THE INVENTION

Air pollution regulations require that when emergency vented hydrocarbons are burned, there be no emission of smoke as the hydrocarbon burns. Since, of the known hydrocarbons, methane alone burns in open air at flares without smoke production, the problem of smoke suppression in flare operation is demanding, since hydrocarbons other than methane must be vented as required by operations.

In the prior art of smokeless flaring of all hydrocarbons, a preferred form of flare design provides for injection of steam, under significant pressure, at or close to the point of initiation of the burning. A variety of reactions and conditions cause steam injection per se to be what is considered as the most effective method for suppression of smoking at the flare. But since at times, a supply of steam for smoke suppression is not available, other means for suppression of smoking have been devised and are now considered common knowledge by those versed in the art.

One such device is tubular in structure and has a blower or fan located at one end of the tube and a burner for the vented hydrocarbons at the other end of the tube. Air is delivered through the tube at significant velocity, by fan or blower and meets the hydrocarbon gases emerging from the burner in such manner that the turbulence created by the velocity of air flow, very greatly speeds the combustion reaction toward the suppression of smoke. Such flares are commonly operated with the primary air tube in the vertical direction with the fan or blower at the bottom end of the tube and the burner at the upper end of the tube.

When the vertically oriented tube is in the open air, the discharge of combustion gases is directly to the atmosphere, but because the quantity of air delivered by the fan or blower is less than the quantity required for complete burning of the vented hydrocarbons, air from the atmosphere is drawn into the combustion zone to supplement fan or blower air, and complete the required combustion reaction. For this reason, atmospheric air must be available immediately as the hydrocarbons begin to burn.

Open air burning of fuels, which makes atmospheric air available for complete hydrocarbon burning, has two great disadvantages. One is that the flame immediately begins unrestricted heat loss by radiation. The second is that in the open air there is virtually constant air movement, by breezes or winds, which further reduces flame temperature, according to the velocity of the air movement. Greater velocity will increase the heat loss from the flame to such a degree that the fuel may cease burning (as when a match is extinguished by blowing on it).

Since fuels burn according to the temperature, turbulence and time, and since as has been stated, wind action cools the flame resulting from burning, it is expedient to protect the burning zone from wind action to avoid temperature reduction in the flame. Maximum flame temperature produces best and most complete hydrocarbon burning. Therefore, if there is no wind flowing against the flame, minimal heat is thus lost from the flame and combustion can better be completed.

Complete combustion occurs where there is no emission of smoke or other products of incomplete combustion such as CO (which is toxic), $H_2$, as well as $CH_2O$ (which is an irritant as well as toxic). Smoking is by far the most predominant pollutant, and can be readily seen, while gaseous pollutants, which typically are not a problem, cannot be seen. It is evident therefore that greatest concern is for avoidance of smoke as hydrocarbons burn.

The tendency for smoke production, that is, escape of unburned carbon as hydrocarbons burn, is a function of the weight-ratio of hydrogen to carbon (H/C) characteristic of the hydrocarbon, when there is no suppression of smoke. When the H/C ratio is 0.33, such as for methane, there is no smoke production. When the H/C ratio is 0.25 smoke production begins and as the H/C ratio falls lower, there is increased production of smoke such that with an H/C ratio of 0.166 (ethylene) the smoke is very dense. All of this is for the case where there is no suppression of smoke.

Smoke can be suppressed by increased turbulence in the burning zone, by air injection to the burning zone, and by high velocity injection of steam to the burning zone, and to combine air injection with increased turbulence by other means known to those versed in the art. However, the effectiveness of such smoke prevention measures is hindered if through wind action the temperature of the flame is decreased as is well known in the art.

In view of the discussion to this point, it would seem obvious to enclose the burning area for avoidance of wind action on the flame. But simple enclosure, per se, is not a solution because as earlier pointed out, there must be ready access of atmospheric air to the burning zone in quantities. Thus the problem of enclosure is burdened with not only access of atmospheric air to the burning zone, but supply of energy for movement of atmospheric air into the flame area for assured complete burning. Note here that when there is escape of carbon (black smoke) from the burning zone there is incomplete combustion of the hydrocarbon.

In typical natural draft fuel burning in furnaces, energy for air movement to the fuel for burning is supplied as draft by chimneys or stacks which, being filled with hot gases, supply draft energy at the stack base in keeping with the gas temperature and with stack height. As an example, a 100 foot high stack when filled with 1,200° F. gases will supply static draft of approximately 1.0 inch WC (0.57 oz.) at its base. Burners are sized for the draft energy which is stack-supplied to assure ample air for fuel burning. Draft energy as supplied by stacks or chimneys is (as has been stated) not great and precaution must be taken to avoid upset in air delivery by draft when additional air is delivered by blowers or fans for the identical condition of fuels burning.

SUMMARY OF THE INVENTION

It is a primary object of this invention to provide a burner and flare stack for complete combustion of vented hydrocarbons with smoke suppression and invisible flame.

It is a further object of this invention to provide complete combustion and smoke suppression without the use of high pressure steam.

These and other objects are realized and the limitations of the prior art are overcome in this invention by using a vertical flare stack lined with ceramic and having a large axial opening in the base. The stack is raised above ground level and is supported upon legs and has a cylindrical wind shield around the exposed portion below the base of the stack where the cylindrical wind shield projects downwardly from the base of the stack only a part of the exposed length. Primary air is provided under pressure in an axial conduit below and terminating at its top end at the floor of the stack. A burner is provided in the top of the primary air conduit for injection of the vented hydrocarbons. Secondary air is supplied through an annular opening between the primary air conduit and the wall of an opening in the floor of the stack. Ceramic lining is provided for the stack in order to provide a high temperature environment around the combustion zone, so as to prevent cooling of the flame by radiation. The turbulence is provided by the pressurized primary air mixing with the gases vented at the burner. Sufficient time for complete combustion is provided by having substantial height to the stack, so that combustion can be carried on throughout the upward flow of the burning gases from the burner to the top of the stack, so that the combustion will be complete before the products reach the top of the stack.

BRIEF DESCRIPTION OF THE DRAWING

These and other objects and advantages of this invention and a better understanding of the principles and details of the invention will be evident from the following description taken in conjunction with the appended drawing, which illustrates a preferred embodiment of the invention, which is in cross section.

DESCRIPTION OF THE PREFERRED EMBODIMENT

Referring now to the drawing there is shown in cross section a preferred embodiment of this invention. It comprises a flare stack indicated generally by the numeral 10, which comprises a circular cylindrical steel wall 16, lined with ceramic 18 on the inside of the wall and 26 on the floor 50 of the stack. There is a circular opening 28 in the floor of the stack.

The stack is raised so that its base 24 is at considerable elevation above the ground 30 and is supported by steel columns or legs 22, which are attached, as by welding, to the cylindrical steel wall of the stack. A cylindrical steel wind screen 56 is provided to enclose a major portion of the space below the stack to prevent wind from disturbing the flow of air to the burner, and to minimize the effect of the blower (fan) suction on air flow distribution. The top of the wind screen is at least as high as the base of the stack. Air flow 58A occurs to the immediate area of the indicated areas 36–37 where the relatively greater energy of blower (fan) suction could badly upset delivery of air 54 if the opening 61 for ready entry of air at atmospheric pressure to areas 36–37 was not provided. Spacing 61 of the lower edge of 56 from ground 30 is air flow area 61 where the area of 61 will permit entry of not less than 10% the total air requirement for fuels combustion when the pressure drop across 61 is 0.06 inch WC. The diameter of the wind screen is sufficiently larger than the diameter of the stack so that adequate air supply can be provided, in accordance with arrow 58, for complete combustion of the vented gases.

Primary air is supplied through an axial conduit indicated generally by the numeral 12, which is supplied with air by means of a fan or blower of conventional design, indicated by the dashed lines 36 and 37. A preferred construction utilizes a flared opening 34 on the bottom end of the conduit 12. Primary air, as shown by the arrows 38 flows from the blower into the conduit and up the conduit in accordance with arrows 39, 40 inside of the steel wall 32 or the conduit, which is supported by means 21 well-known in the art.

A burner 42 for the vented gases is supported inside of the primary air conduit, the burner being positioned at the top of the conduit. The top of the conduit is positioned at the floor 50 of the stack. Conduit means 44 are provided for the combustion gases, which flow in the direction of the arrow 46. Pilot light means such as 48 are provided for maintaining a continuous flame at the burner, so that upon sudden initiation of flow 46, the gases will be ignited at the burner by the flame from the pilot 48.

Since the primary air flow indicated by arrows 38, 39 and 40 is under considerable velocity, there will be considerable turbulence between the air and the gas as it flows from the burner 42. This turbulence promotes faster and more complete combustion.

The opening 28 in the floor of the stack is large enough so that the annular space between the primary air conduit and the wall 28 of the opening is sufficient for the supply of secondary air, which flows in accordance with arrows 54 and 60, through the annular space and into the flame zone above the burner so as to provide sufficient air for complete combustion of the hydrocarbons. If desired, a flared shroud 52 can be provided so as to make the flow of air 54 more efficient and therefore to supply a greater amount of air to the flame for a given draft. The flow of secondary air is induced into the combustion zone by the draft due to the stack height and the temperature of the gases within the stack as is well-known in the art.

In operation, the primary air flows at high velocity in the conduit 12 and mixes turbulently with the vented gases provided by the burner 42. The gas and air mixture is ignited by the pilot light 48 and combustion takes place in the region above the burner near the base of the stack.

Secondary air flows into the annular space between the wind screen 56 and the wall 16 of the stack in accordance with arrow 58 and then into the blower 36 for primary air and in accordance with arrows 54 for the secondary air. The secondary air flows in accordance with arrows 60 into the flame, where it is turbulently mixed with the hot gases to permit complete combustion.

Because of the heat of the flame, the ceramic lining 18 and 26 of the stack rapidly heats to a high temperature corresponding to that of the combustion gases. As a result, there is no radiation from the flame and the combustion gases are not cooled. Also, because of the high temperature of the flame, complete combustion can be carried out quickly. As the burning gases move up the stack, combustion can continue inside of the heated ceramic lining and combustion will be complete before the products reach the top of the stack.

Essential features of the invention comprise (1) a primary air supply under high velocity for turbulent mixing with the fuel, (2) adequate secondary air at the point of flame ignition and burning, (3) a ceramic lining for the stack so that the flame will operate in a high temperature environment, and (4) adequate stack height to provide draft for the secondary air and for complete combustion before the products of combustion reach the top of the stack.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of equivalency to which each element or step thereof is entitled.

What is claimed is:

1. A low pollution invisible flame flare burner comprising:

a. a flare stack having a cylindrical steel wall of substantial height and a ceramic lining, said stack supported on legs above the ground;

b. a cylindrical windscreen for shielding the space below said stack from the wind, the screen diameter larger than the diameter of said stack, said screen having its bottom edge spaced above said ground and its top edge at least as high as the base of said stack;

c. primary air conduit means below and coaxial with said stack, the top of said conduit extending through an opening in the floor of said stack to the level of said floor of said stack;

d. burner means inside said primary air conduit supported at the top of said conduit;

e. blower means to induce primary air flow in said conduit at high velocity; and f. means to supply secondary air through the annular space between said conduit and the wall of said opening in the floor of said stack.

2. The flare burner as in claim 1 in which said height of said stack is sufficient to generate a draft sufficient to supply sufficient secondary air for complete combustion of the vented hydrocarbons.

3. The flare burner as in claim 1 in which said height of said stack is in the range of 50 to 150 feet.

4. The flare burner as in claim 1 in which said height of said stack is at least 100 feet.

5. The flare burner as in claim 1 including flared shroud means to facilitate secondary air flow through the annular space between said conduit and the wall of said opening.

6. The flare burner as in claim 1 including pilot light means.

7. A low pollution invisible flame flare burner comprising:

a. a flare stack having a cylindrical steel wall of substantial height and a ceramic lining, said stack supported on legs above the ground;

b. a cylindrical windscreen for shielding the space below said stack from the wind, said windscreen spaced with its bottom edge above the ground by a selected distance such that at least 10% of the total air required for fuel combustion can pass through the space between the windscreen and the ground with a pressure drop no greater than 0.05 inch WC.

c. primary air conduit means below and coaxial with said stack, the top of said conduit extending through an opening in the floor of said stack to the level of said floor of said stack;

d. burner means inside said primary air conduit supported at the top of said conduit;

e. means to induce primary air flow in said conduit at high velocity; and f. means to supply secondary air through the annular space between said conduit and the wall of said opening in the floor of said stack.

8. The flare burner as in claim 7 in which said air inducing means comprises fan means.

* * * * *